United States Patent [19]

Fält

[11] Patent Number: 4,716,816

[45] Date of Patent: Jan. 5, 1988

[54] HYDRAULIC MOTOR

[75] Inventor: Vilho Fält, Iisalmi, Finland

[73] Assignee: Oy Partek Ab, Parainen, Finland

[21] Appl. No.: 934,448

[22] PCT Filed: Mar. 19, 1986

[86] PCT No.: PCT/FI86/00026

§ 371 Date: Nov. 13, 1986

§ 102(e) Date: Nov. 13, 1986

[87] PCT Pub. No.: WO86/05554

PCT Pub. Date: Sep. 25, 1986

[30] Foreign Application Priority Data

Mar. 20, 1985 [FI] Finland ..... 851107

[51] Int. Cl.[4] ..... F01B 13/06; F01B 31/00

[52] U.S. Cl. ..... 91/491; 92/130 R

[58] Field of Search ..... 91/491, 492, 488; 417/273, 214; 91/130 R

[56] References Cited

U.S. PATENT DOCUMENTS 2,481,754 9/1949 Johnson ..... 91/494

4,225,291 9/1980 Bouwkamp ..... 417/214

*Primary Examiner*—William L. Freeh

*Attorney, Agent, or Firm*—Scully, Scott, Murphy & Presser

[57] ABSTRACT

The invention relates to a hydraulic motor, in which a rotating motion is generated by a combined effect of a cam ring (2) and roller means (5) connected to the pistons (5) of a cylinder group (3).The object is to provide a new dummy coupling solution for a motor of this kind. To the cylinder group (3), preferably between two cylinders (4), is fastened a generally T-shaped support (8, 9) and round each branch (9) of the T is mounted a spiral spring (11) influencing respective piston (5). One end (12) of each spring influences the piston (5) through a passage (17) formed in the cylinder wall and the other end (13) of the spring leans against the support (8).

4 Claims, 4 Drawing Figures

HYDRAULIC MOTOR

The invention relates to a hydraulic motor, in which a rotating motion is generated by a combined effect of a cam ring and roller means connected to the pistons of a cylinder group and in which in connection with each piston in the cylinder group is arranged a spiral spring leaning against the cylinder group to disengage the piston with its roller means from the cam ring when the pressure ducts of the motor are connected to a space without pressure. The motor can be rotated freely by means of an outer force, if the roller means of the pistons, e.g. the piston rollers, are disengaged from the cam ring.

It is known to carry out this dummy coupling by connecting the pressure ducts of the motor with a space without pressure and by leading an overpressure into the motor casing, which overpressure disengages the pistons with their roller means and keeps them in disengagement from the cam ring. For this purpose, however, a pressure source is needed.

It is also known to arrange a dummy coupling by means of draw springs, which springs connect with each other the axle stubs joining together the pistons and piston rollers of a radial piston motor and which springs thus create force components pulling the pistons with the rollers towards the centre of the motor. The axle stubs required for the solution constitute a disadvantage.

The object is to provide a new and less complicated solution to a dummy coupling of a hydraulic motor.

A hydraulic motor of the invention is mainly characterized in that one end of the spiral spring mounted to lean against a support is arranged to influence the piston through a passage formed in the wall of the cylinder and the other end is arranged to lean against the support, while the spring thus acts as torsion spring.

A spiral spring acting as torsion spring is preferably used, which spring is mounted on a support fastened to the cylinder group, whereby one end of the spring is arranged to influence the piston through a passage formed in the cylinder wall and the other end of the spring is arranged to lean against the support. The support can generally resemble the letter T, whereby it is at its shaft fastened between two cylinders and round the branches a continuous spiral spring can be mounted, in the middle of which there is a substantially U-shaped supporting portion located against the shaft of the support.

In the dummy coupling of the invention there is thus no need of a pressure source or axle stubs mentioned above. The construction is simple and solid.

In the following, the invention is described in more detail with reference to the enclosed schematic drawing.

Figure 1:
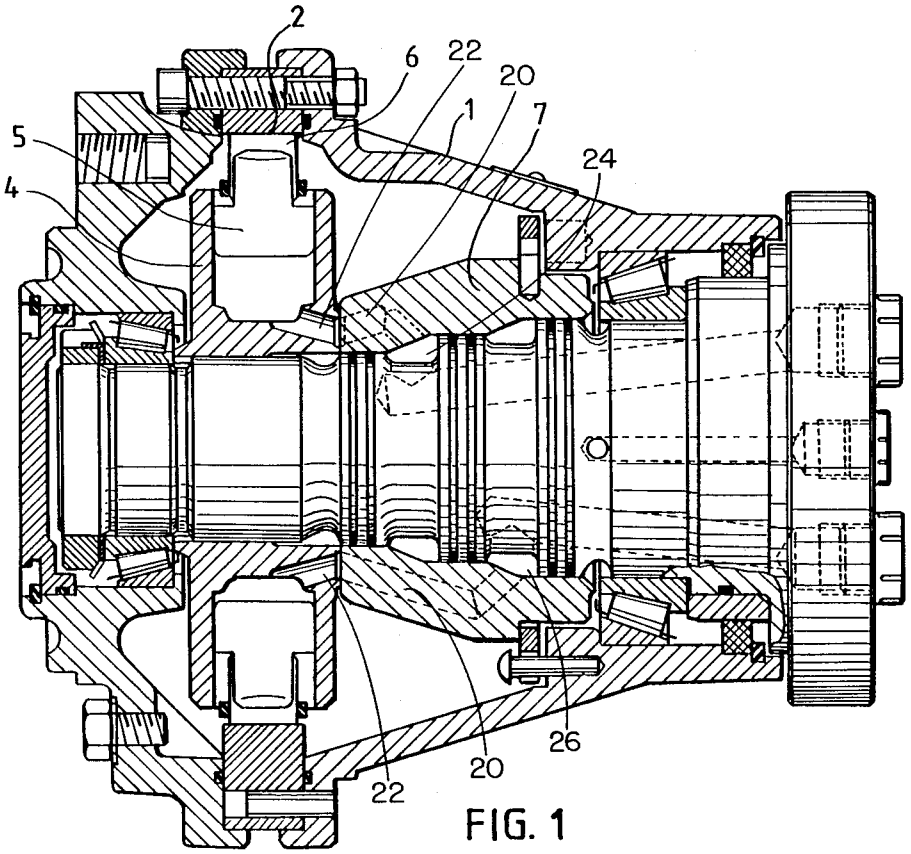
FIG. 1 is a longitudinal section of a radial piston motor.
Figure 2:
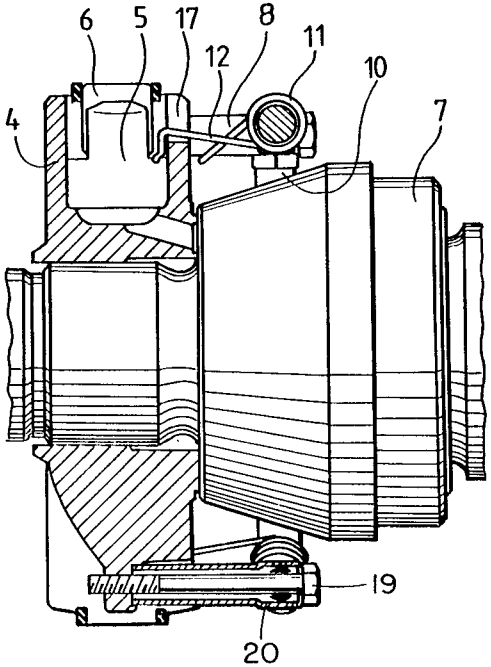
FIG. 2 is a corresponding section of a cylinder group with dummy coupling springs.
Figure 3:
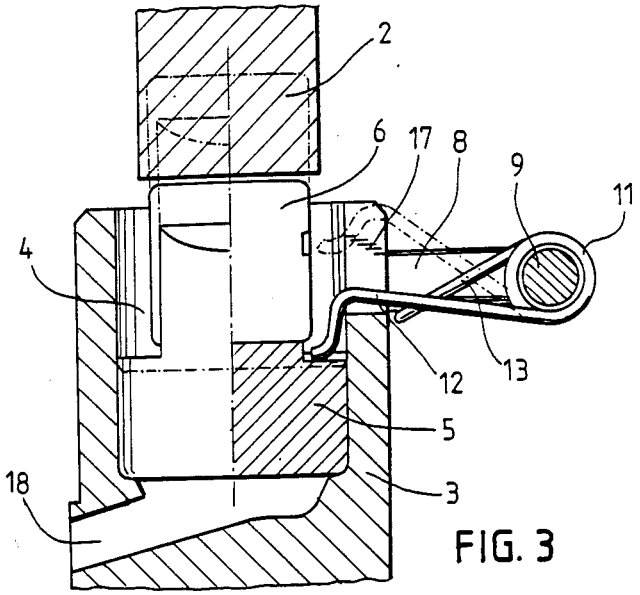
FIG. 3 is a section of one cylinder.
Figure 4:
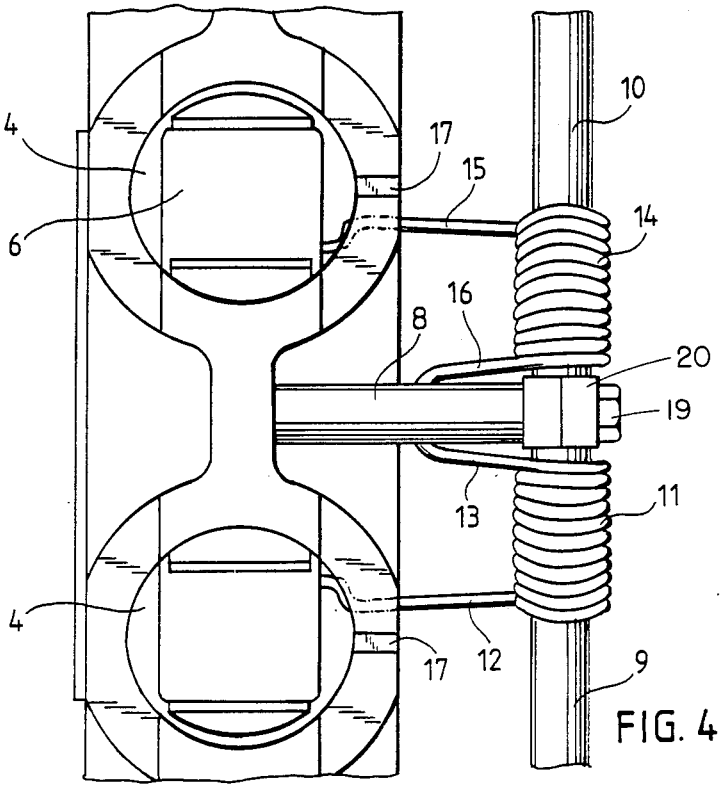
FIG. 4 illustrates two adjacent cylinders from above.

In the embodiment example according to the drawing the hydraulic motor includes a rotating jacket, i.e. a casing 1 with cam rings 2. Pistons 5 moving to and fro in the cylinders 4 of a non-rotating cylinder group 3 make the casing 1 to rotate by means of rollers 6. The construction suggested for the dummy coupling of the motor is not presented in FIG. 1, but as it is apparent from FIG. 2, it can be located in the space defined by the casing 1, the cylinder group 3 and a plane divider 7. In the following, the FIGS. 2, 3 and 4 are referred to.

Plane divider 7 is a valving member that includes a plurality of fluid ports 20. Cylinders 4 have a corresponding number of passages 22 for transitting fluid between the cylinders 4 and the valving ports 20. The valving ports 20 are alternately connected to a high pressure chamber 24 or an exhaust chamber 26 as the casing 1 rotates.

In each particular case between two cylinders 4 is fastened a generally T-shaped support 8, 9, 10, the branches 9 and 10 of which are curved or form with each other an angle and thus at least substantially follow the periphery of the cylinder group 3. The branches 9 and 10 are not fastened to the divider 7, as could perhaps be thought on the basis of FIG. 2. As it is best apparent from FIG. 4, a spiral spring consisting of two halves 11 and 14 is mounted round the branches 9 and 10 of the support, one half 11 round the branch 9 and the other half 14 round the branch 10. The ends 12 and 15 of the spring, each of them, press through a passage 17 made in the cylinder wall the piston 5 of respective cylinder 4 into the inside position (FIG. 3), when the pressure ducts 18 are connected to a space without pressure, and move to and fro in the passages 17, when the motor is functioning. The shaft 8 of the support forms a counter support, against which a supporting branch 13, 16 formed in the middle of the spring and resembling the letter U is leaning from the direction of the centre of the cylinder group 3; consequently, the spring 11, 14 works like a torsion spring.

The construction described in the drawings is simple and reliable, but the invention is not limited only to that. Instead of a continuous spring, two separate springs 11 and 14 could be used, whereby the ends 13 and 16 of the springs could separately lean against the shaft 8 of the support or against the openings or notches made in the branch 9 respectively 10 of the support. The branches 9 and 10 can extend continuously along the periphery of almost the whole cylinder group, or for each cylinder there can be a separate, e.g. L-shaped spring support.

In the example case of the drawing, the shaft 8 of the support is hollow, whereby the fastening to the cylinder group can be carried out by means of a bolt 19 extending through it, for which bolt a bore with an inner thread is made in the cylinder group. At the end 20 of the shaft 8 there are side openings, through which the branch-T 9, 10 can be threaded and in the branch-T again, there is a transverse opening for the bolt 19, as it is apparent from the lower part of the FIG. 2. Also other fastening methods can, of course, be used.

I claim:

1. Hydraulic motor, in which a rotating motion is generated by a combined effect of a cam ring (2) and roller means (6) connected to the pistons (5) of a cylinder group (3) and in which in connection with each piston (5) in the cylinder group (3) is arranged a spiral spring (11; 14) leaning against the cylinder group (3) to disengage the piston (5) with its roller means (6) from the cam ring (2) when the pressure ducts of the motor are connected to a space without pressure, characterized in that one end (12; 15) of the spiral spring (11; 14) mounted to lean against a support (8, 9, 10) is arranged to influence the piston (5) through a passage (17) formed in the wall of the cylinder (4) and the other end (13; 16) is arranged to lean against the support (8), while the spring (11; 14) thus acts as torsion spring.

2. Hydraulic motor according to claim 1, characterized in that the support (8, 9, 10) of the spring (11; 14) is generally T-shaped and at its shaft (8) fastened to the cylinder group (3) between two cylinders (4) and that round each branch (9; 10) of the T is mounted a spiral spring (11; 14) influencing respective piston (5).

3. Hydraulic motor according to claim 2, characterized in that round the branches (9; 10) of the T-shaped support is mounted a continuous spiral spring (11, 14) which in the middle leans against the shaft (8) of the support.

4. Hydraulic motor according to claim 3, characterized in that the spiral spring consists of two halves (11, 14), the adjacent ends (13, 16) of which form a continuous, substantially U-shaped supporting portion located against the shaft (8) of the support.

* * * * *